US009899733B1

(12) United States Patent
Platt

(10) Patent No.: US 9,899,733 B1
(45) Date of Patent: Feb. 20, 2018

(54) MULTIBAND BLADE ANTENNA

(75) Inventor: John Jeremy Churchill Platt, Grand Haven, MI (US)

(73) Assignee: R.A. MILLER INDUSTRIES, INC., Grand Haven, MI (US)

( * ) Notice: Subject to any disclaimer, the term of this patent is extended or adjusted under 35 U.S.C. 154(b) by 1338 days.

(21) Appl. No.: 13/370,957

(22) Filed: Feb. 10, 2012

Related U.S. Application Data

(60) Provisional application No. 61/488,950, filed on May 23, 2011.

(51) Int. Cl.
*H01Q 1/38* (2006.01)

(52) U.S. Cl.
CPC ..... *H01Q 1/38* (2013.01)

(58) Field of Classification Search
USPC ..... 343/700 MS
See application file for complete search history.

(56) References Cited

U.S. PATENT DOCUMENTS 3,210,764 A 10/1965 Anderson et al.
4,072,952 A 2/1978 Demko
4,438,437 A 3/1984 Burgmyer
4,509,053 A 4/1985 Robin et al.
5,610,620 A 3/1997 Stites et al.
5,621,420 A 4/1997 Benson
6,873,296 B2 3/2005 Langley et al.
7,098,862 B2 8/2006 Regala
7,589,683 B2 9/2009 McKivergan et al.
7,633,451 B2 12/2009 Robin et al.
7,746,282 B2 6/2010 Lin et al.
2007/0210972 A1* 9/2007 Robin et al. ..... 343/705
2010/0033401 A1* 2/2010 Du ..... 343/893
2010/0302116 A1 12/2010 Patrick et al.

OTHER PUBLICATIONS

Sensor Systems Inc., VHF/UHF AM/FM S65-8282-512, http://www.sensorantennas.com/antenna_pdf/VHF_UHF/S65-8282-512.pdf, Sensor Systems, Inc., Chatsworth, California, USA, www.SensorAntennas.com.

* cited by examiner

*Primary Examiner* — Andrea Lindgren Baltzell
(74) *Attorney, Agent, or Firm* — McGarry Bair PC

(57) ABSTRACT

A multi-band blade antenna with an open sleeve and slanted design housed within a blade antenna housing. The blade antenna has three resonant bands with one very high frequency (VHF) band and two ultra-high frequency (UHF) bands.

17 Claims, 5 Drawing Sheets

MULTIBAND BLADE ANTENNA

BACKGROUND OF THE INVENTION

Antennas are commonly required in nautical and aeronautical applications for the purposes of communicating with an aircraft or boat. It is often advantageous to have multiband antennas in these applications so that a reduced number of antennas are required for communications on all required frequency bands. U.S. Pat. No. 5,621,420 shows an example of a duplex monopole antenna for use with aircrafts, vehicles and marine vessels. This antenna design however is not aerodynamic and therefore may not be well suited for vehicular, aeronautical, or nautical applications. U.S. Pat. No. 7,746,282 shows an example of a more compact multiband antenna for aircraft applications.

Blade antennas, in particular, are commonly used in nautical and aeronautical applications due to their compact and aerodynamic footprint relative to other types of antennas such as monopole, dipole or whip antennas. Blade antennas can also be designed and constructed for receiving and radiating at multiple bands or over a very wide band. Blade antennas further provide the advantage of being more mechanically robust in presence of vibrations experienced during operation on aircrafts compared to many other types of antennas. Blade antennas are typically constructed by providing metal traces on one or both sides of an insulated board, such as an FR-4 circuit board or a fiber glass circuit board. These traces are of dimensions to provide resonance in the particular targeted frequency bands of the antenna. U.S. Pat. No. 7,633,451 shows an example of a blade type multiband antenna for aircraft applications.

SUMMARY OF THE INVENTION

One embodiment of the invention relates to a compact multiband blade antenna with a slanted design. The compact multiband blade antenna provides all three bands required for general aviation, namely very-high frequency (VHF), ultra-high frequency (UHF) and upper UHF, in a single blade and having a single connection port. Therefore, for aviation applications, only a single antenna is required, rather than multiple antennas. The slanted design provides for greater aerodynamics when mounted, for example, on the outside of an aircraft. The compact multiband blade antenna has an open sleeve element that allows for minimal interaction between the three bands.

In another embodiment, a phasing element is provided on a compact multiband blade antenna to further reduce size of the antenna and reduce interactions between the multiple resonant bands of the antenna.

DETAILED DESCRIPTION OF THE INVENTION

The present invention is related to a multi-band blade antenna with a compact footprint and targeted for aeronautical and nautical communications applications. In particular, the multi-band blade antenna has three resonant frequency bands with an open sleeve and slanted design. One embodiment includes a phase element to further reduce the size and form factor of the blade antenna.

Figure 2:
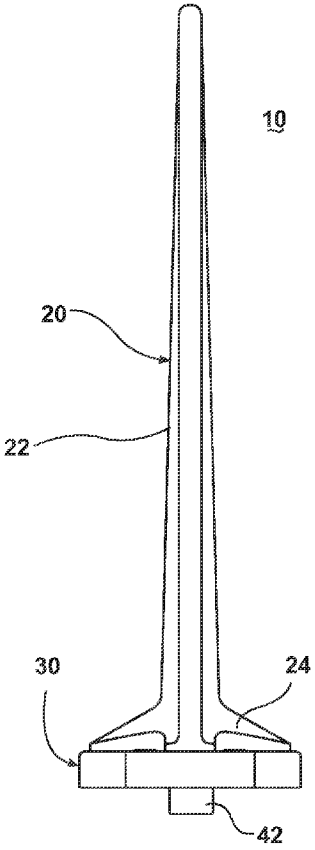
FIG. 2 is a schematic front view of the exterior housing of the multi-band blade antenna with an open sleeve of FIG. 1.
Figure 1:
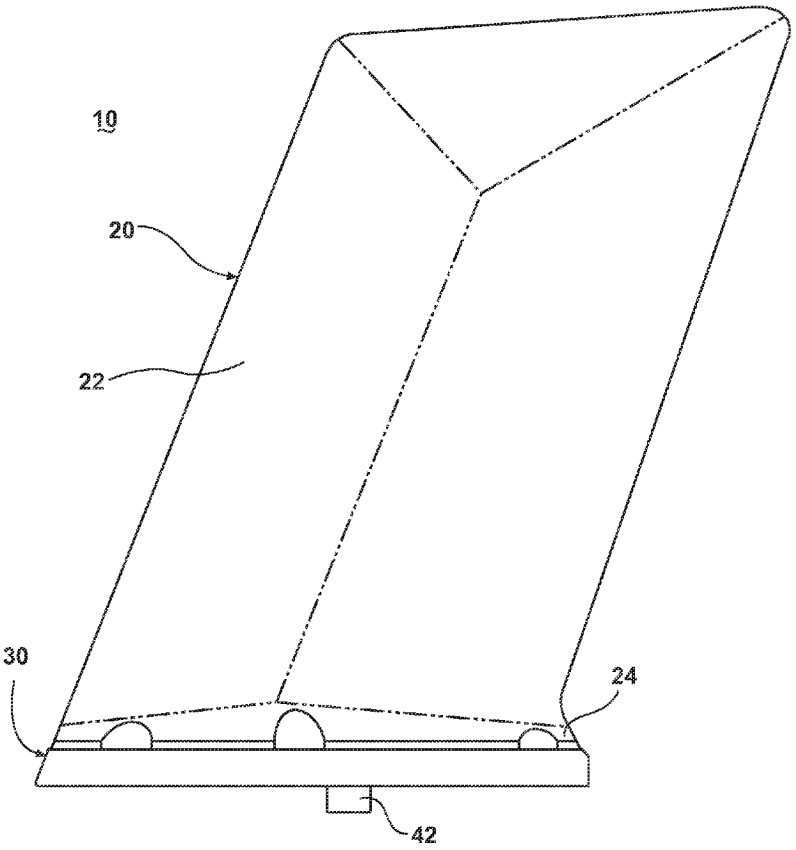
FIG. 1 is a schematic side view of the exterior housing of a multi-band blade antenna with an open sleeve according to one embodiment of the present invention.

Referring to FIGS. 1 and 2, the blade antenna 10 comprises an extended housing 20 extending from a base housing 30. The extended housing 20 further comprises a sidewall 22 and a base portion 24 that mates with and attaches to the base housing 30. The extended housing 20 can be slanted and the sidewall 22 can have a bowed profile. Extending from the base housing 30 is a blade antenna main board connector 42 for electrically connecting the blade antenna 10 to downstream or upstream electronics (not shown), such as radios transmitters, radio receivers, or any other electronics that require an antenna.

The blade antenna 10 can be mounted on the outer surface of a vehicle, boat, or aircraft and therefore the slanted design of the extended housing 20 can provide for advantageous aerodynamic performance, such as reducing drag resulting from the extension of the blade antenna 10 from an aircraft. The extended housing may be fabricated from sheets of fiber glass cloth reinforced with resin.

Figure 3:
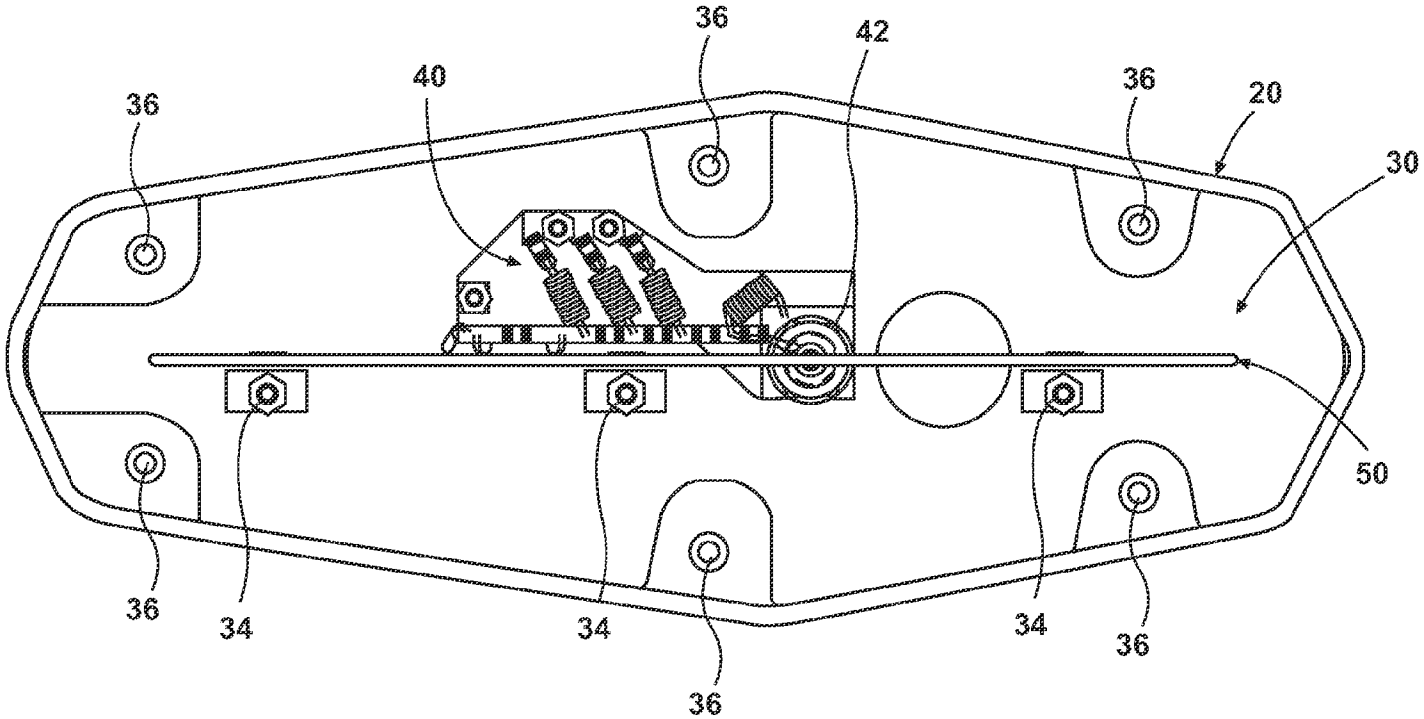
FIG. 3 is a schematic top view of the interior of the multi-band blade antenna with an open sleeve showing a main board of the blade antenna of FIG. 1.

Referring now to FIG. 3, the interior of the blade antenna 10 is seen without the extended housing 20. The base housing 30 can accommodate mechanical fasteners 36 to attach the blade antenna 10 to a vehicle, aircraft, or boat. A blade antenna main board 50 is attached to the base housing via mechanical fasteners 34. The blade antenna main board 50 comprises the conductive elements for the reception and transmission of the desired frequency bands, as is discussed in greater detail below in conjunction with FIGS. 4 and 5. The blade antenna main board 50 is connected to a base connector board 40. The base connector board 40 serves the purpose of matching and feeding signals between the blade antenna main board 50 and downstream or upstream electronics (not shown) via the main board connector 42.

Figure 4:
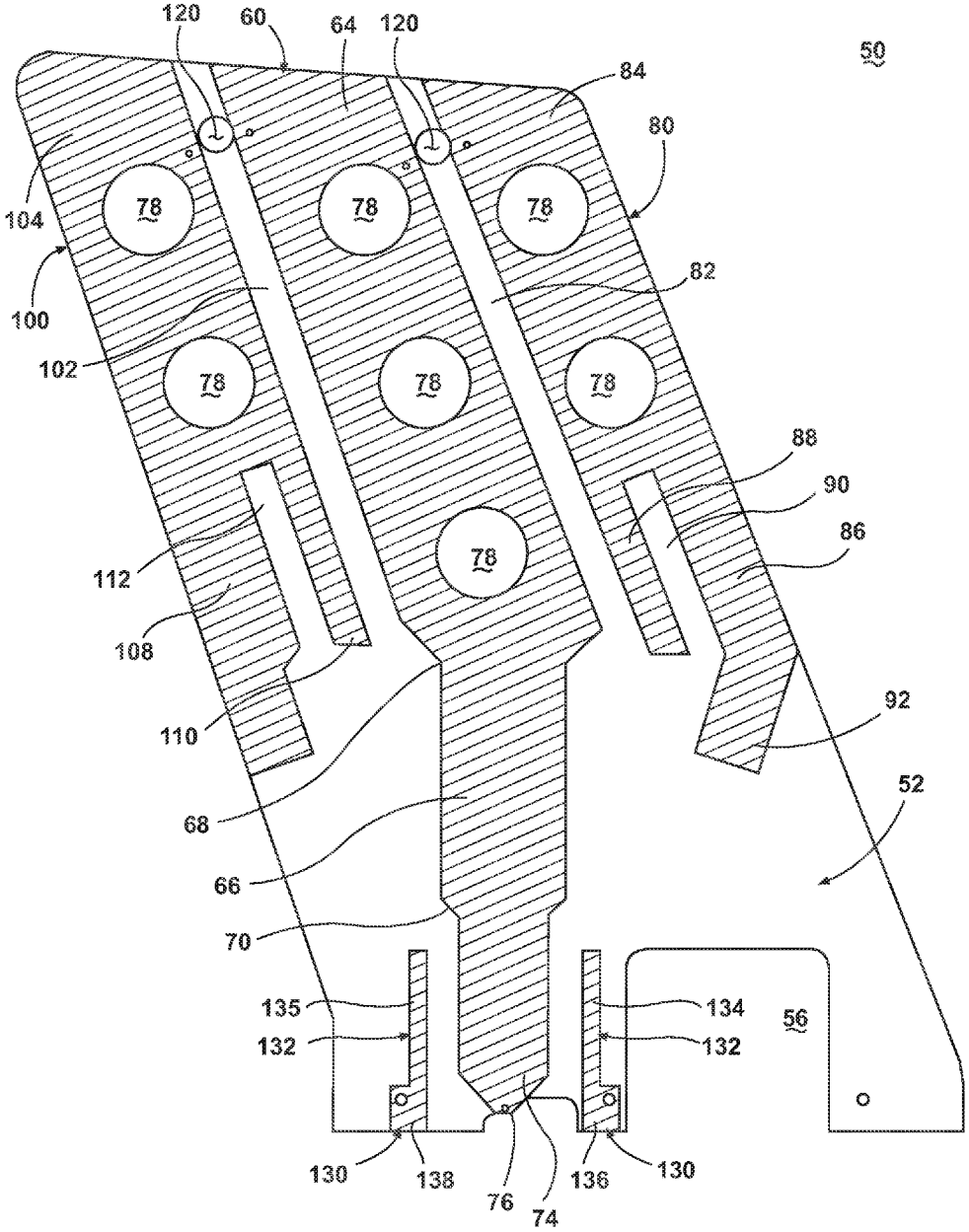
FIG. 4 is a schematic side view of the main board of the blade antenna of FIG. 1.

Referring now to FIG. 4, the antenna main board 50 comprises a circuit board 52 that is slanted in shape to fit within the slanted profile of the extended housing 20 with conductive elements disposed on both sides of the circuit board 52. The circuit board 52 further has a cut-out region 56 to accommodate the blade antenna main board connector 42 that protrudes from the base connector board 40 in the fully assembled blade antenna 10. In FIG. 4, the conductive elements on only one side of the circuit board 52 are shown, though it is to be noted that the same patterns shown in FIG. 4 are replicated on the side not shown in the drawing. Furthermore, similar conductive patterns on one side of the circuit board 52 are electrically connected to the corresponding patterns on the other side of the circuit board 52. The circuit board 52 may be a standard FR-4 type board or any other known type of insulative circuit board.

For the purposes of spatial description of elements on the antenna main board 50, the term "top" shall describe the edge of the circuit board 52 most distal from the base connector board 40 of the fully assembled blade antenna 10. The term "bottom" shall describe the edge of the circuit board most proximal to the base connector board 40 of the fully assembled blade antenna 10. The term "forward" shall refer to the direction toward the leading edge shown on the right of FIG. 4, and the term "rearward" shall refer to the direction toward the trailing edge shown on the left of FIG. 4. It will be understood that in typical applications, the leading edge will be disposed toward the direction of travel of the vehicle to which the antenna is mounted, and the trailing edge will be disposed behind the leading edge and away from the direction of travel. The term "center" refers to a region that is substantially between forward and rearward areas on the blade.

A center element 60 is disposed approximately at the center of the circuit board 52 and extends from the top to the bottom of the antenna main board 50. The center element 60 comprises an upper portion 64, a lower portion 66, a transition area 68 between the upper and lower portions, a lower portion tapper 70, a center element connector 74, and a connector end 76. There are open holes 78 disposed in the upper portion 64 that extend through to the other side of the circuit board 52. The holes 78 are metallized such that the center element 60 on one side of the antenna main board 50 is connected to the center element (not shown) on the other side of the antenna main board 50. The antenna main board 50 when assembled within the extended housing 20 may contain foam (not shown) to mechanically insulate the antenna main board 50 from the extended housing 20 to prevent damage to the antenna main board 50. The holes 78 may also have foam passing therethrough to provide improved mechanical reliability of the blade antenna 10.

The upper portion 64 resonates at the very-high frequency (VHF) band, or approximately between 136 and 174 MHz. The slanted design has minimal effects on the performance of the upper portion 64 at the VHF frequency. In other words, little or no modification has to be made to the geometry (length and width) for the upper element 64 regardless of whether the circuit board 52 is slanted or not slanted. In this antenna main board 50 design, the upper element 64 is approximately one quarter (¼) of the targeted wavelength of the VHF band.

The lower portion 66 resonates at the lower of the two ultra-high frequency (UHF) bands, or approximately between 380 and 520 MHz. The lower portion 66 is physically connected to the upper portion 64 via the upper portion to lower portion transition 68. The lower portion 66 is further connected to the center element connector 74 via the lower portion trapper 70. The center element connector 74 terminates at the connector end 76 at the bottom of the circuit board 52. The connector end 76 is electrically connected to the blade antenna main board connector 42 and is configured to provide a path for signals for all of the elements on the antenna main board 50 for all three bands of the blade antenna 10.

Still referring to FIG. 4, disposed on the circuit board 52 is a forward element 80 and a rearward element 100. There is a slot 82 between the forward element 80 and the center element 60 and a slot 102 between the rearward element 100 and the center element 60. The slots 82 and 102 are for blocking the UHF band, or approximately between 380 to 520 MHz. Each of the forward and rearward elements 80 and 100 comprise element extensions 86, 88, 92, 108, and 110 and ¼ wavelength slots 90 and 112 between the extensions 86, 88, 92, 108, and 110. By appropriately sizing and placing the element extensions 86, 88, 92, 108, and 110 and ¼ wavelength slots 90 and 112, the upper UHF band, or approximately between 760 and 870 MHz can be blocked for the blade antenna 10. In the illustrated embodiment of FIG. 4, the slant of the antenna main board in the upper UHF band requires the ¼ wavelength slots 90 and 112 to be between the element extensions 86, 88, 92, 108, and 110. The forward and rearward elements 80 and 100 also comprise ¼ wave traps 84 and 104 near the top of the circuit board 52 for the purpose of electrically decoupling the upper UHF band from the other two bands. The forward and rearward elements 80 and 100 may also contain holes 78 therethrough, which can provide for an electrical conduit from one side of the circuit board 52 to the other, as well as provide a means to impart greater mechanical stability to the circuit board 52 when packaged within the extended housing 22 with foam for mechanical damping of vibrations.

A space 120 is provided for connecting the forward and rearward elements 80, 100 to the center element 60 via a discrete electrical part (not shown). The discrete electrical part can be a passive electrical part such as a resistor, inductor, or capacitor of any value, a stripline, or any combination thereof. The discrete part can sit within the space 120 of a fully assembled blade antenna 10. Alternatively, the forward and rearward elements 80, 100 may be connected to the center element by a trace on the circuit board 52, rather than any discrete electrical parts.

The antenna main board 50 further comprises an open sleeve 132 with open sleeve conductive traces 134 and 135 on either side of the center element connector 74 and each open sleeve trace having an open sleeve connector 136 and 138. The open sleeve 132 is typically electrically grounded in a fully assembled blade antenna 10 via connectors 136 and 138. When the blade antenna 10 is in use, the open sleeve 132 provides for a low impedance path for the upper UHF band signals via the center element connector 74.

Figure 5:
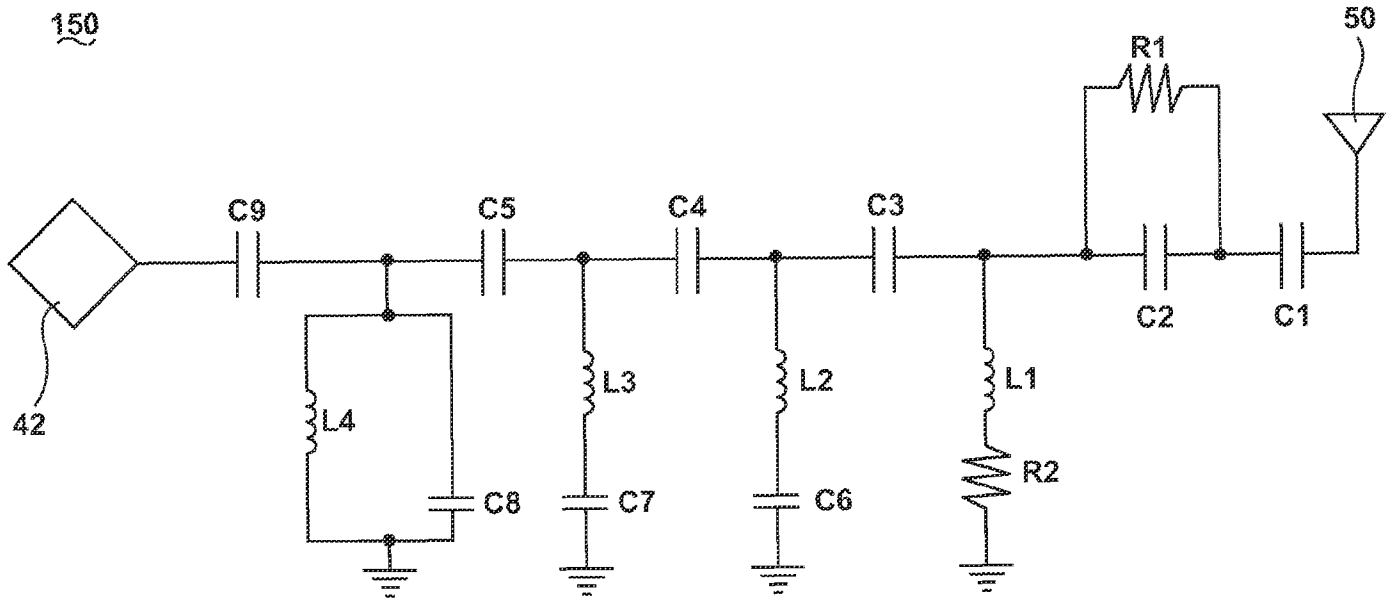
FIG. 5 is an illustration of an equivalent circuit representation of a blade antenna connector board of the blade antenna of FIG. 1.

Referring now to FIG. 5, the equivalent circuit diagram 150 of the main board connector board 40 with the blade antenna main board 50 connected on the right hand side and the blade antenna main board connector 42 on the left hand side is discussed. The equivalent circuit representation 150 is comprised of resistors R1 and R2, capacitors C1, C2, C3, C4, C5, C6, C7, C8 and C9, and inductors L1, L2, L3, and L4. By selecting appropriate values of each of the components of the circuit 50, the blade antenna main board can be electrically matched and coupled to the input impedance and output impedance of the blade antenna main board connector 42 along with upstream or downstream electronics.

Figure 6:
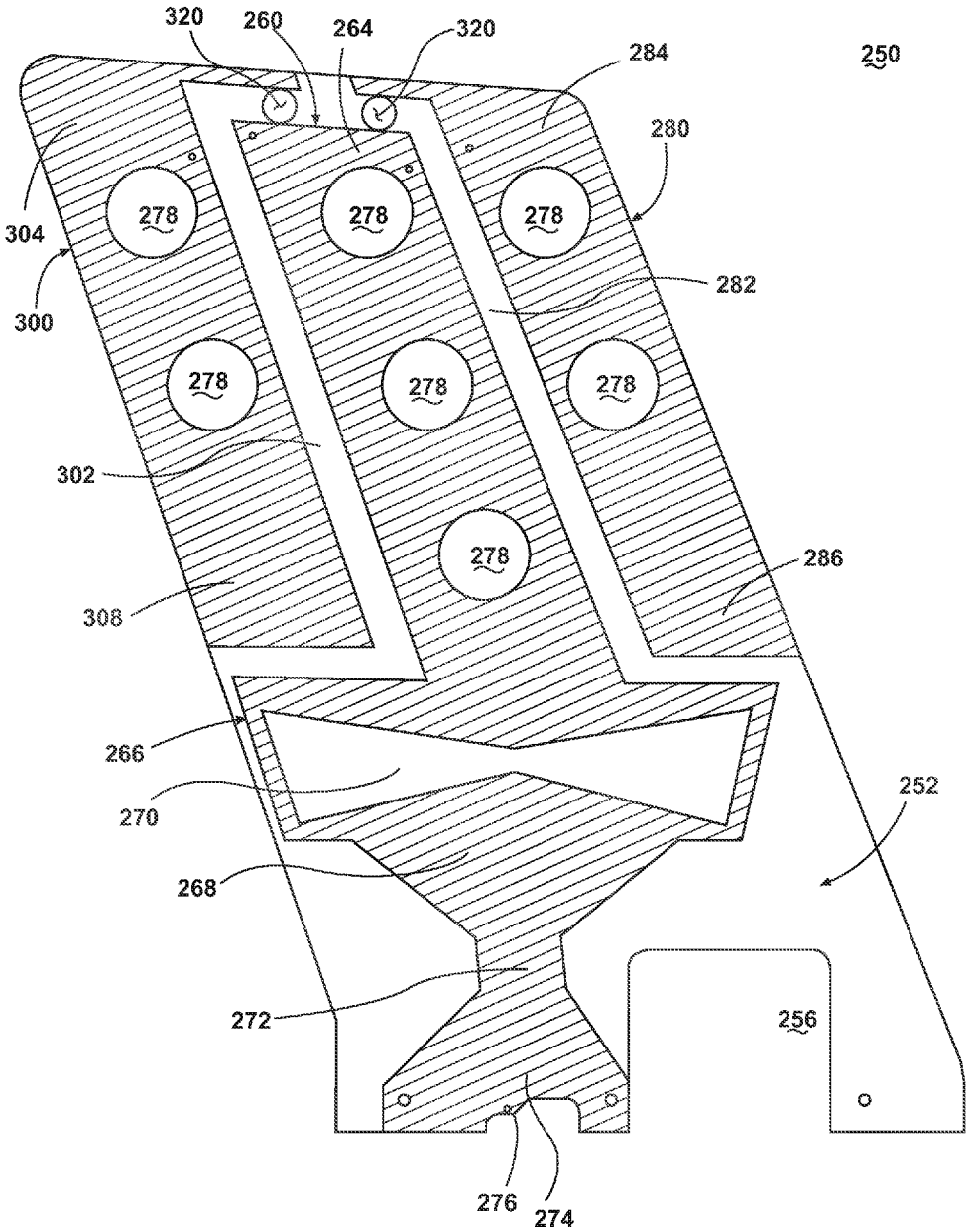
FIG. 6 is a schematic side view of the main board of a blade antenna according to another embodiment of the present invention.

Referring now to FIG. 6, another embodiment of the blade antenna board 250 is discussed. Unlike the blade antenna board 50, blade antenna board 250 has a phasing element 266 and does not have an open sleeve element. As in circuit board 52, circuit board 252 of blade antenna board 250 has a cut-out region 256 to accommodate the blade antenna main board connector 42 that protrudes from the base connector board 40 in the fully assembled blade antenna 10. The conductive elements on only one side of the circuit board 252 is shown, however, it should be noted that the same patterns as the patterns shown are replicated on the side not shown in the drawings. Similar conductive patterns on one side of the circuit board 252 are electrically connected to the corresponding patterns on the other side of the circuit board 252.

A conductive center element 260 disposed on circuit board 252 comprises an upper portion 264, the phasing element 266, a lower portion 272, a connector 274, and a connector end 276. The upper portion 264 resonates at the VHF band, and the lower portion 272 resonates at the lower of the two UHF bands. The phasing element 266 comprises a conductive region 268 and a non-conductive region 270. In other words, the phasing element 266 has metal forming the conductive region 268 disposed on the circuit board 252 surrounding non-metalized areas of the non-conductive region 270. The phasing element 268 serves to provide a path for the current from the VHF band to center element 260, rearward element 300, and forward element 280, while providing high impedance to currents in the upper UHF band, such that upper UHF currents do not reach the center element 260, rearward element 300 and forward element 280 and thus do not radiate. The upper portion 264 is connected to the conductive region 268 of the phasing element 266 and the phasing element 266 is further connected to the lower portion 272 and the lower portion is connected to the connector 274. The center element connector 274 terminates at the connector end 276 at the bottom of the circuit board 252. The connector end 276 is electrically connected to the blade antenna main board connector 42 and is configured to provide a path for signals for all of the elements on the antenna main board 250 for all three bands of the blade antenna 10.

The antenna board 250 further comprises a forward element 280 and a rearward element 300, separated from the center element 260 by slots 282, and 302, respectively. The forward and rearward elements 280 and 300 comprise lower regions 286 and 308, respectively, for receiving and radiating the VHF band. The forward and rearward elements 280 and 300, along with the upper portion 264 of the center element 260 function as ¼ wave traps for the purpose of electrically decoupling the UHF band from the upper parts of the circuit board 252 above the phasing element 266.

A space 320 is provided for connecting the forward and rearward elements 280, 300 to the center element 260 via a discrete electrical part (not shown). The discrete electrical part can be a passive electrical part such as a resistor, inductor, or capacitor of any value, a stripline connection, or any combination thereof. The discrete part(s) can sit within the space 320 of a fully assembled blade antenna 10. Alternatively, the forward and rearward elements 280, 300 may be connected to the center element 260 by a trace on the circuit board 252, rather than any discrete electrical parts.

As in the case of antenna main board 50, for antenna main board 250, the forward and rearward elements 280, 100 and center element 260 may contain holes 278 therethrough. The holes 278 can provide for an electrical conduit from one side of the circuit board 252 to the other, as well as a means to impart greater mechanical stability to the circuit board 252 when packaged within the extended housing 22 with foam for mechanical damping of vibrations.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A multi-band blade antenna comprising:

a dielectric circuit board having a top edge and a bottom edge, a center conductive element disposed on the circuit board, having an upper portion configured to resonate in the VHF band, a lower portion configured to resonate in the lower UHF band, and a connector portion terminating at the bottom edge;

at least one second element disposed on the circuit board, spaced from the center conductive element by a lower UHF blocking slot, and configured to resonate in the upper UHF band, wherein the at least one second element is electrically connected to the center conductive element; and one of an open sleeve element disposed on the circuit board adjacent to the connector portion, and a phasing element disposed on the circuit board between the upper portion and the lower portion.

2. The multi-band antenna of claim 1 comprising an open sleeve element adjacent to the connector portion.

3. The multi-band antenna of claim 2 wherein the open sleeve element comprises conductive elements on either side of the connector portion.

4. The multi-band antenna of claim 3 wherein each conductive element has an open sleeve connector adapted to connect to ground to provide a low impedance path for the upper UHF band.

5. The multi-band antenna of claim 4 wherein the upper portion extends from the top edge.

6. The multi-band antenna of claim 2 wherein the at least one second element has extensions separated from each other by an upper UHF blocking slot.

7. The multi-band antenna of claim 1 comprising a phasing element between the upper portion and the lower portion.

8. The multi-band antenna of claim 7 wherein the phasing element has a conductive region surrounding a non-conductive region.

9. The multi-band antenna of claim 8 wherein the upper portion extends from near the top edge.

10. The multi-band antenna of claim 1 comprising two second elements, one on either side of the center conductive element.

11. The multi-band antenna of claim 1 wherein the at least one second element is electrically connected to the center conductive element via a space.

12. The multi-band antenna of claim 1 wherein circuit board has identical elements on both sides.

13. The multi-band antenna of claim 12 wherein the like elements on both sides are electrically connected to each other.

14. The multi-band antenna of claim 13 wherein the electrical connections are through open holes in the circuit board.

15. The multi-band antenna of claim 1 wherein the at least one second element is slanted relative to the bottom edge.

16. The multi-band antenna of claim 1 further comprising a ¼ wave trap near the top edge of the at least one second element.

17. The multi-band antenna of claim 1 further comprising a cutout region to accommodate a main board connector that connects the connector portion to a matching circuit.

* * * * *